US005384529A

United States Patent [19]

Nakago

[11] Patent Number: 5,384,529

[45] Date of Patent: Jan. 24, 1995

[54] CURRENT LIMITING CIRCUIT AND METHOD OF MANUFACTURING SAME

[75] Inventor: Manabu Nakago, Tokyo, Japan

[73] Assignee: NEC Corporation, Tokyo, Japan

[21] Appl. No.: 188,319

[22] Filed: Jan. 28, 1994

[30] Foreign Application Priority Data

Feb. 1, 1993 [JP] Japan ..... 5-014377

[51] Int. Cl.[6] ..... G05F 3/04; G05F 3/08

[52] U.S. Cl. ..... 323/312; 323/907

[58] Field of Search ..... 323/312, 907, 299, 234, 323/282

[56] References Cited

U.S. PATENT DOCUMENTS 4,527,213 7/1985 Ariizumi ..... 361/56
4,716,356 12/1987 Vyne et al. ..... 323/312
4,885,525 12/1989 Gontowski, Jr. ..... 323/312 X

FOREIGN PATENT DOCUMENTS 20194 1/1988 Japan .

*Primary Examiner*—Kristine L. Peckman

*Assistant Examiner*—E. To

*Attorney, Agent, or Firm*—Whitham, Curtis, Whitham & McGinn

[57] ABSTRACT

A current limiting circuit which includes a vertical MOS transistor as an output transistor has a clamping voltage that can be established with high accuracy, and once established, is less dependent on temperature. The gate of an output N-channel VDMOS transistor is connected to a constant-voltage circuit composed of an N-channel VDMOS transistor having the same characteristics as those of the output N-channel VDMOS transistor and two series-connected resistors which supply a divided voltage to the gate of the N-channel VDMOS transistor. The clamping voltage between the gate and source of the output N-channel VDMOS transistor can be adjusted based on the voltage divided by the resistors of the constant-voltage circuit. The temperature characteristics of the output N-channel VDMOS transistor and the constant-voltage circuit are held in phase with each other to reduce variations in the clamping voltage caused by temperature variations.

2 Claims, 3 Drawing Sheets

CURRENT LIMITING CIRCUIT AND METHOD OF MANUFACTURING SAME

BACKGROUND OF THE INVENTION

1. Field of the Invention

The present invention relates to a current limiting circuit and a method of manufacturing such a current limiting circuit, and more particularly to a current limiting circuit capable of preventing an overcurrent from flowing when a load thereof is short-circuited, and a method of manufacturing such a current limiting circuit.

2. Description of the Related Art

As shown in FIG. 1 of the accompanying drawings, a conventional current limiting circuit comprises an output N-channel vertical MOS transistor (hereinafter referred to as an "output VDMOS transistor") 11 having a gate connected to an input terminal 16, a source connected to ground, and a drain which is supplied with a power supply potential VDD through a load 17, an N-channel MOS transistor (hereinafter referred to as an "NMOS transistor") 13 having a gate connected to the drain of the output VDMOS transistor 11 and a source connected to ground, and three diodes 15 connected in forward direction between the drain of the NMOS transistor 13 and the gate of the output VDMOS transistor 11.

When an input signal is applied to the input terminal 16, the output VDMOS transistor 11 is rendered conductive. If an overcurrent flows through the output VDMOS transistor 11 due to a short-circuit across the load, for example, while the output VDMOS transistor 11 is conductive, the voltage between the drain and source of the output VDMOS transistor 11 is increased, rendering the NMOS transistor 13 conductive. When the NMOS transistor 13 is conductive, the voltage between the gate and source of the output VDMOS transistor 11 is equalized to the sum of the forward voltages across the three diodes 15 and the voltage across the NMOS transistor 13 as it is turned on. Since the output VDMOS transistor 11 operates in a saturated region, it can limit the current flowing therethrough to a certain constant level.

In the illustrated conventional current limiting circuit, the clamping voltage between the gate and source of the output VDMOS transistor 11 is established by a multiple of the forward voltage of each diode 15. Consequently, the clamping voltage can only be selected in steps of about 0.6 V, which is the forward voltage of a general diode, and hence the clamping voltage cannot be set to a desired value more accurately.

Furthermore, inasmuch as the forward voltage of a diode varies greatly as the temperature varies, the clamping voltage tends to shift from the selected value depending on the temperature.

SUMMARY OF THE INVENTION

According to the present invention, there is provided a current limiting circuit comprising an output first N-channel vertical MOS transistor having a gate to which is supplied an input signal, a drain to which is supplied a power supply potential through a load, and a source connected to ground; an N-channel MOS transistor having a gate connected to the drain of the first N-channel vertical MOS transistor and a source connected to ground; first and second resistors connected in series between the gate of the first N-channel vertical MOS transistor and the drain of the N-channel MOS transistor; and a second N-channel vertical MOS transistor having the same characteristics as those of the first N-channel vertical MOS transistor, the second N-channel vertical MOS transistor having a drain connected to the gate of the first N-channel vertical MOS transistor, a source connected to the drain of the N-channel MOS transistor, and a gate to which is supplied a voltage divided by the first and second resistors.

According to the present invention, there is also provided a current limiting circuit comprising an output first N-channel vertical MOS transistor having a gate to which is supplied an input signal, a drain to which is supplied a power supply potential, and a source connected to a load; an N-channel MOS transistor having a gate connected to the drain of the first N-channel vertical MOS transistor and a drain connected to the gate of the first N-channel vertical MOS transistor; first and second resistors connected in series between the source of the N-channel MOS transistor and the load; and a second N-channel vertical MOS transistor having the same characteristics as those of the first N-channel vertical MOS transistor, the second N-channel vertical MOS transistor having a drain connected to the source of the N-channel MOS transistor, a source connected to the source of the first N-channel vertical MOS transistor, and a gate to which is supplied a voltage divided by the first and second resistors.

When either of the above current limiting circuits is manufactured, the first N-channel vertical MOS transistor and the second N-channel vertical MOS transistor are fabricated on the same semiconductor substrate according to the same process.

With the above arrangement, a clamping voltage for saturating the first N-channel vertical MOS transistor is established by a constant-voltage circuit composed of the second N-channel vertical MOS transistor. Since an output voltage of the constant-voltage circuit is determined by a voltage divided by the first and second resistors, the clamping voltage can be set to a desired value by selecting the resistances of the resistors.

Inasmuch as the first N-channel vertical MOS transistor and the second N-channel vertical MOS transistor are of the same characteristics, even when the temperature varies, the characteristics of the first and second N-channel vertical MOS transistors vary in the same manner. As a consequence, the operating characteristics of the current limiting circuit do not vary depending on the temperature.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
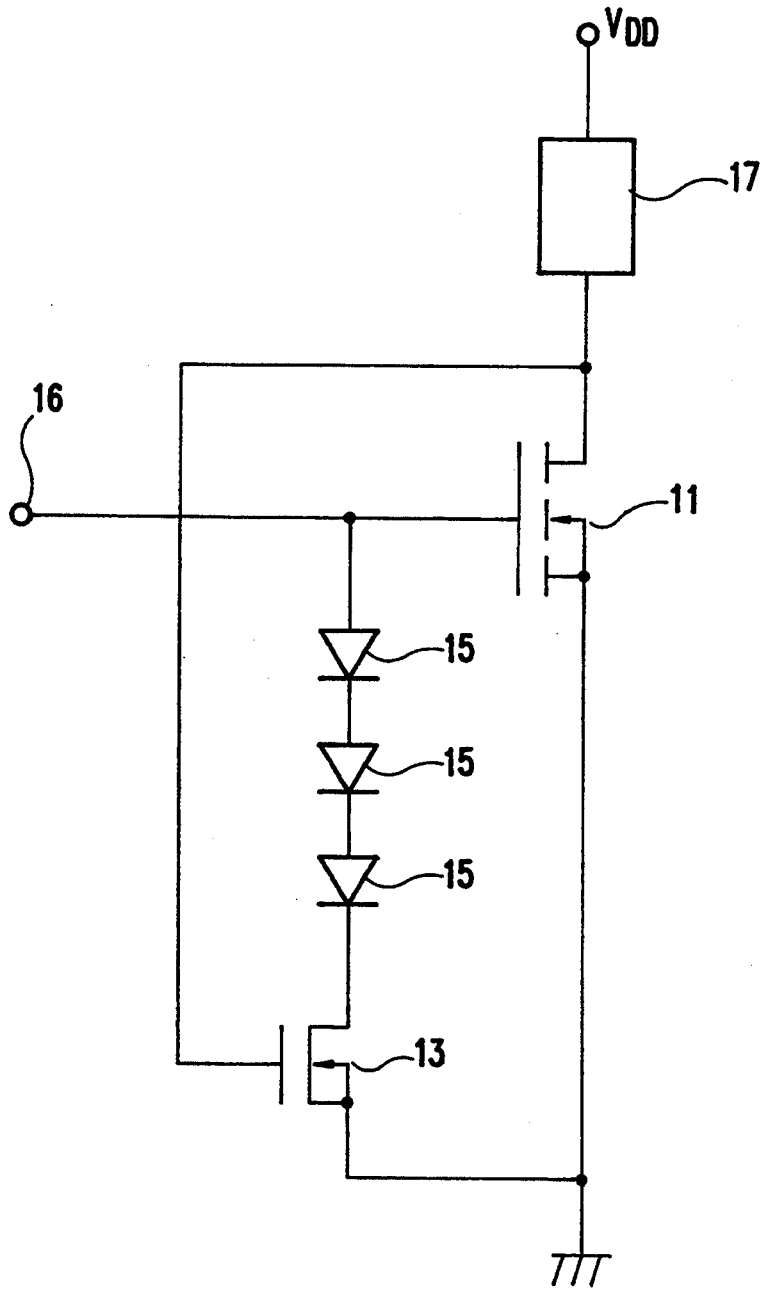
FIG. 1 PRIOR ART
FIG. 1 is a circuit diagram of a conventional current limiting circuit.
Figure 2:
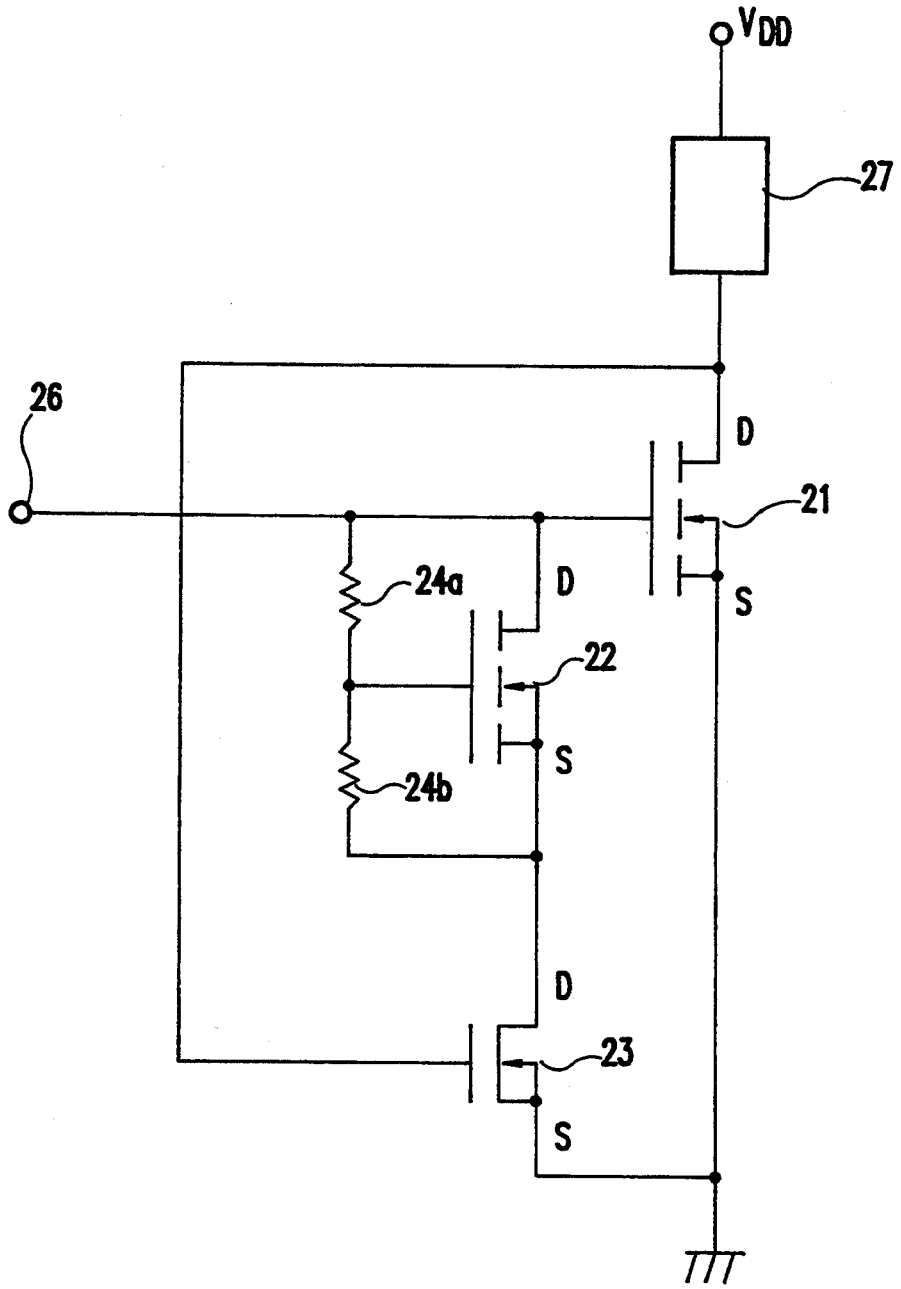
FIG. 2 is a circuit diagram of a current limiting circuit according to a first embodiment of the present invention.

As shown in FIG. 2, a current limiting circuit according to a first embodiment of the present invention comprises an output VDMOS transistor 21 having a gate connected to an input terminal 26, a source connected to ground, and a drain which is supplied with a power supply potential VDD through a load 27; a switching NMOS transistor 23 having a gate connected to the drain of the output VDMOS transistor 21 and a source connected to ground; two resistors 24*a*, 24*b* connected in series between the drain of the NMOS transistor 23 and the gate of the output VDMOS transistor 21; and an N-channel vertical MOS transistor (hereinafter referred to as an "N-ch VDMOS transistor") 22 which has the same characteristics as those of the output VDMOS transistor 21.

The N-ch VDMOS transistor 22 has a gate to which a voltage divided by the resistors 24*a*, 24*b* is applied, a drain connected to the input terminal 26, and a source connected to the drain of the NMOS transistor 23.

Operation of the current limiting circuit shown in FIG. 2 will be described below.

When a signal applied to the input terminal 26 is of a low level, the output VDMOS transistor 21 is rendered nonconductive. When the output VDMOS transistor 21 is not conductive, the NMOS transistor 23 is rendered conductive as an input signal is applied thereto.

When a high-level signal is applied to the gate of the output VDMOS transistor 21, a constant-voltage circuit composed of the N-ch VDMOS transistor 22 and the resistors 24*a*, 24*b* operates to clamp the input signal to a certain constant voltage. The clamped input voltage renders the output VDMOS transistor 21 conductive, whereupon the voltage between the drain and source thereof drops. When the voltage between the drain and source of the output VDMOS transistor 21 becomes lower than a threshold voltage VT of the NMOS transistor 23, the NMOS transistor 23 is rendered nonconductive, whereupon the input signal is applied directly to the gate of the output VDMOS transistor 21.

If a large current flows through the output VDMOS transistor 21 due to a failure such as a short-circuit across the load 27 while the input signal is being applied directly to the gate of the output VDMOS transistor 21, the voltage between the drain and source of the output VDMOS transistor 21 is increased, rendering the NMOS transistor 23 conductive. The constant-voltage circuit composed of the N-ch VDMOS transistor 22 and the resistors 24*a*, 24*b* then operates to clamp the voltage between the gate and source of the output VDMOS transistor 21 to a certain constant voltage. The output VDMOS transistor 21 switches from an unsaturated operating region to a saturated operating region, limiting the current flowing through the output VDMOS transistor 21 to a certain constant level.

Figure 3:
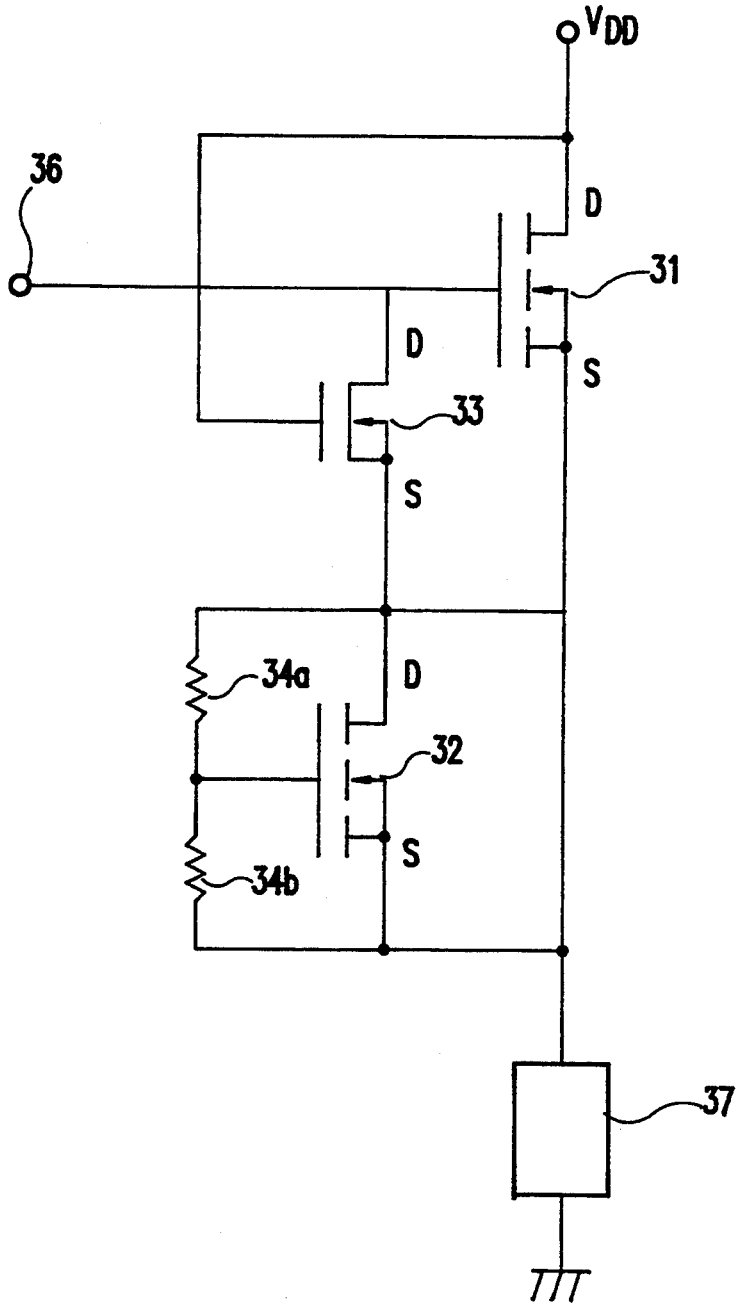
FIG. 3 is a circuit diagram of a current limiting circuit according to a second embodiment of the present invention.

FIG. 3 shows a current limiting circuit according to a second embodiment of the present invention. As shown in FIG. 3, the current limiting circuit according to the second embodiment comprises an output VDMOS transistor 31 having a gate connected to an input terminal 36, a source connected to ground through a load 37, and a drain which is supplied with a power supply potential VDD; a switching NMOS transistor 33 having a gate supplied with the power supply potential VDD and a drain connected to the gate of the output VDMOS transistor 31; two resistors 34*a*, 34*b* connected in series between the source of the NMOS transistor 33 and the source of the output VDMOS transistor 31; and an N-ch vertical MOS transistor 32 which has the same characteristics as those of the output VDMOS transistor 31. The N-ch vertical MOS transistor 32 has a gate to which a voltage divided by the resistors 34*a*, 34*b* is applied, a source connected to the source of the output VDMOS transistor 31, and a drain connected to the source of the NMOS transistor 33.

The current limiting circuit according to the second embodiment is of the high-side switching type whereas the current limiting circuit according to the first embodiment shown in FIG. 2 is of the low-side switching type.

If an overcurrent flows through the output VDMOS transistor 31 due to a short-circuit across the load 37 while the output VDMOS transistor 31 is conductive, the voltage between the drain and source of the output VDMOS transistor 31 rises. As a result, the NMOS transistor 33 is rendered conductive to clamp the voltage between the gate and source of the output VDMOS transistor 31 to a certain constant voltage. Therefore, an output current flowing through the output VDMOS transistor 31 is limited to a certain constant level.

In order to allow the output VDMOS transistor 31 and the N-ch vertical MOS transistor 32 to have the same characteristics, it is preferable that the output VDMOS transistor 31 and the N-ch vertical MOS transistor 32 be fabricated on the same semiconductor substrate according to the same process.

While a bipolar transistor may be employed in the constant-voltage circuit, bipolar transistors are not preferable because they have widely varying threshold voltage correlations and temperature characteristics, thereby failing to achieve desired high accuracy, and also because their manufacture entails a relatively large number of manufacturing steps and they have a large power requirement.

With the current limiting circuit according to the present invention, as described above, the clamping voltage between the gate and source of the output VDMOS transistor for limiting an overcurrent flowing through the output VDMOS transistor is established by the constant-voltage circuit which is composed of the N-ch VDMOS transistor having the same characteristics as those of the output VDMOS transistor and the two resistors for applying a divided voltage to the gate of the N-ch VDMOS transistor. Therefore, the clamping voltage can be set to a desired level with high accuracy. The temperature characteristics of the output VDMOS transistor and the N-ch VDMOS transistor are held in phase with each other to reduce temperature-dependent characteristic variations or fluctuations.

Although certain preferred embodiments of the present invention have been shown and described in detail, it should be understood that various changes and modifications may be made therein without departing from the scope of the appended claims.

What is claimed is:

1. A current limiting circuit comprising:

an output first N-channel vertical MOS transistor having a gate to which is supplied an input signal, a drain to which is supplied a power supply potential through a load, and a source connected to ground;

an N-channel MOS transistor having a gate connected to the drain of said first N-channel vertical MOS transistor and a source connected to ground;

first and second resistors connected in series between the gate of said first N-channel vertical MOS transistor and a drain of said N-channel MOS transistor; and a second N-channel vertical MOS transistor having the same characteristics as those of said first N-channel vertical MOS transistor, said second N-channel vertical MOS transistor having a drain connected to the gate of said first N-channel vertical MOS transistor, a source connected to the drain of said N-channel MOS transistor, and a gate to which is supplied a voltage divided by said first and second resistors.

2. A current limiting circuit comprising:

an output first N-channel vertical MOS transistor having a gate to which is supplied an input signal, a drain to which is supplied a power supply potential, and a source connected to a load;

an N-channel MOS transistor having a gate connected to the drain of said first N-channel vertical MOS transistor and a drain connected to the gate of said first N-channel vertical MOS transistor;

first and second resistors connected in series between a source of said N-channel MOS transistor and said load; and a second N-channel vertical MOS transistor having the same characteristics as those of said first N-channel vertical MOS transistor, said second N-channel vertical MOS transistor having a drain connected to the source of said N-channel MOS transistor, a source connected to the source of said first N-channel vertical MOS transistor, and a gate to which is supplied a voltage divided by said first and second resistors.

* * * * *